United States Patent [19]

Yano

[11] Patent Number: 4,863,027

[45] Date of Patent: Sep. 5, 1989

[54] BAG ROLL CUTTING DEVICE

[75] Inventor: Kaichi Yano, Tokyo, Japan

[73] Assignee: Showa Marine Kogyo Kabushiki Co., Ltd., Tokyo, Japan

[21] Appl. No.: 186,994

[22] Filed: Apr. 27, 1988

[30] Foreign Application Priority Data

Apr. 30, 1987 [JP] Japan ..... 62-104836

[51] Int. Cl.[4] ..... B26F 3/02; B65D 85/671

[52] U.S. Cl. ..... 206/390; 225/106

[58] Field of Search ..... 225/106, 94, 6, 10, 225/16; 226/127; 206/554, 390, 409, 225; 242/55-53

[56] References Cited

U.S. PATENT DOCUMENTS

| | | | |
|---|---|---|---|
| 2,864,495 | 3/1956 | Ritchie | 206/409 |
| 3,150,808 | 9/1964 | Vensel | 225/106 |
| 3,702,672 | 11/1972 | Becht | 225/106 |
| 3,718,251 | 2/1973 | Barnett | 242/55.53 |
| 4,171,047 | 10/1979 | Doyle et al. | 225/106 |
| 4,180,160 | 12/1979 | Ogawa et al. | 225/106 |

*Primary Examiner*—Frank T. Yost
*Assistant Examiner*—Rinaldi Rada
*Attorney, Agent, or Firm*—L. Lawton Rogers, III; Joseph M. Killeen

[57] ABSTRACT

A bag roll cutting device in which a bag roll comprising a series of wrapping bags wound up to form a roll is vertically accommodated in a container, the series of wrapping bags being constituted by an elongated cylindrical synthetic resin film flattened in the form of a band on which straight-line weldings are applied at certain intervals to form bottoms with score lines provided adjacent to the bottoms to allow the individual bags to be easily cut off. A cylindrical frictional cutter with an inside surface having a high degree of frictional resistance is secured to a top cover which is detachably fitted to the container in such a manner that the cylindrical frictional cutter is connected to a through hole of suitable size provided in the top cover. The front end portion of the bag roll is drawn out through the cylindrical frictional cutter from the end portion of the bag roll in the axial direction of the bag roll in the form of a string. A bag can be cut off the roll by pulling diagonally upwardly the front end of the bag roll with the aid of the tension and friction generated by the cylindrical frictional cutter.

7 Claims, 3 Drawing Sheets

BAG ROLL CUTTING DEVICE

BACKGROUND OF THE INVENTION

Conventionally a continuous body (abbreviated to "bag roll" hereinafter) formed by a series of wrapping bags made of synthetic resin film of the type shown in FIG. 4 is used for wrapping merchandise in supermarkets and so on.

A bag roll of the type described above is so constituted that an elongated cylindrical synthetic resin film 91 is flattened to form a band shape. In order to form bags A, bottoms 92 are provided by applying straight-line welding at a certain interval. Furthermore, in order to allow each bag A to be easily cut off, score lines 93 in the form of, for example, perforations are provided adjacent to the bottoms 92. The thus-formed series of bags A is wound up in the form of a roll, whereby a bag roll 9 is obtained.

Conventionally, the bag roll 9 is rotatably supported by a lateral shaft disposed between the top ends of two arms which project at the sides of a bag cutting device, the bag roll 9 being exposed. Therefore, when it is intended to cut off the bag A, the bag roll 9 is drawn out and brought into contact with the above-described cutting device. The bag A is then pulled in the tangential direction relative to the outer diameter of the roll in such a manner as to tear off the bag roll 9. This action may cause the cutting device to fall due to the inherent tension. Consequently the cutting device must be fixed to a heavy frame or fastened to a wall when installed for use.

However, since such bag rolls are used in an exposed state in the above-described conventional device or method, the conditions are too unsanitary for the bags to be used to accommodate items of food. Furthermore, since bag roll is drawn out in the direction of its rotation, it is difficult to catch the end portion of the bag roll 9 and to open the bag A is also difficult because of the tendency of the two sides of the bag A to stick to each other due to the static electricity generated. Furthermore, a problem arises in that the cutting device cannot be located freely due to the limitations noted above.

SUMMARY OF THE INVENTION

Therefore, an object of the present invention is to overcome the above-described problems by providing a bag roll cutting device which is not only sanitary and easily transported, but allows bag rolls to be easily drawn out and individual bags to be easily opened by solving the problem of static electricity as well being unlimited with respect to potential locations.

BRIEF DESCRIPTION OF THE ACCOMPANYING DRAWINGS

DETAILED DESCRIPTION OF THE PREFERRED EMBODIMENT

Figure 1:
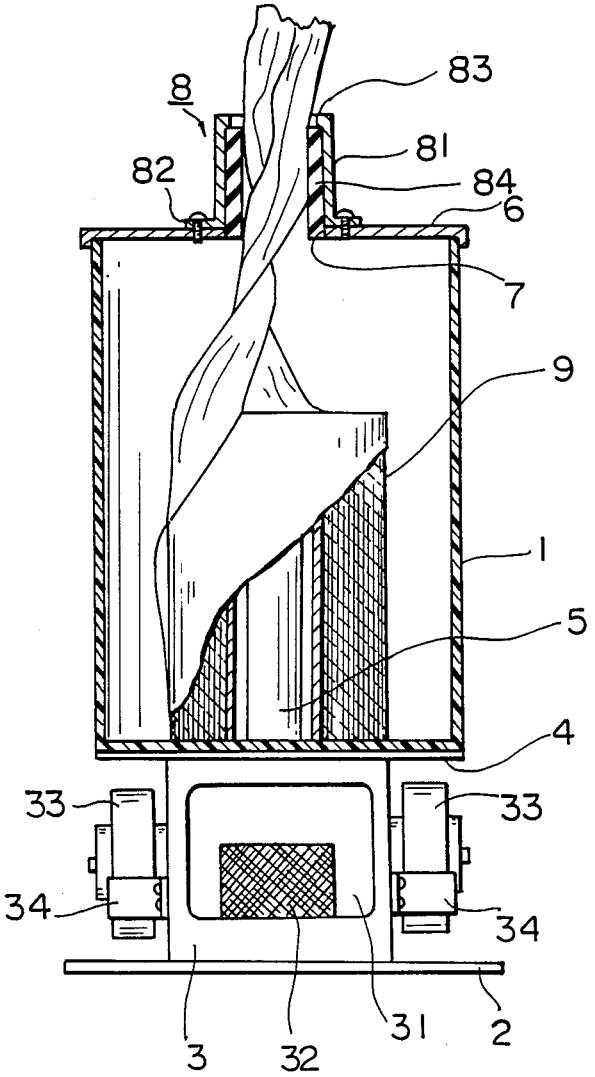
FIG. 1 is a front view in which an essential portion of a bag roll cutting device according to the present invention is illustrated in a cross-sectional manner.
Figure 2:
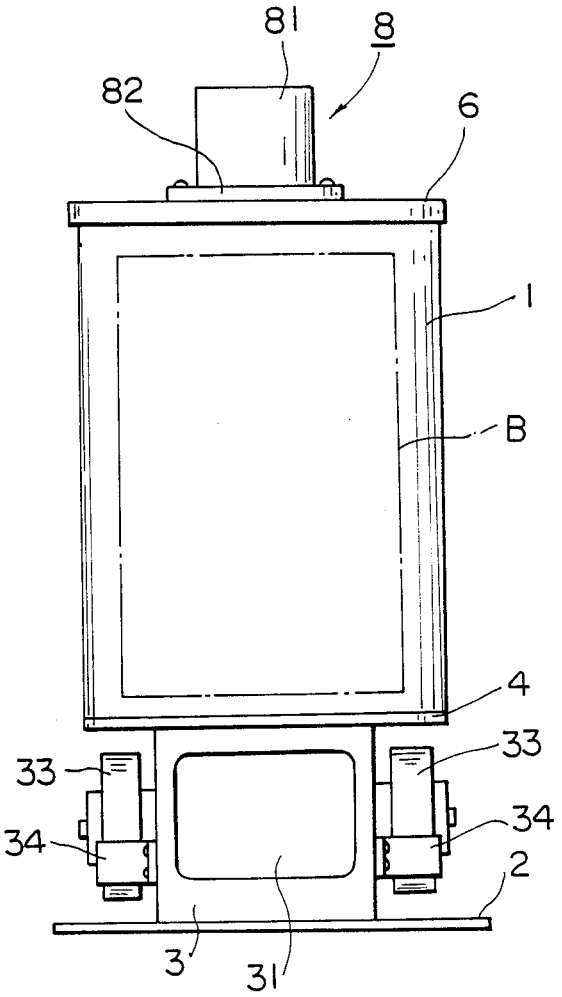
FIG. 2 is a front view of the device according to the present invention.
Figure 3:
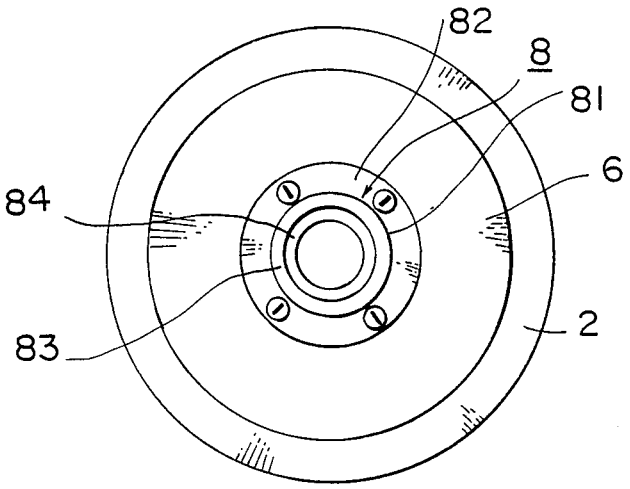
FIG. 3 is a plan view of the same.
Figure 4:
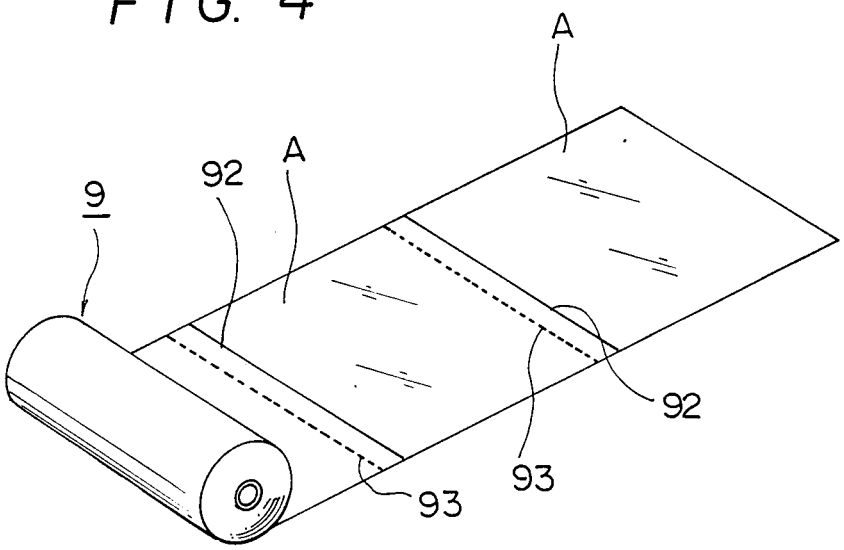
FIG. 4 is a view illustrating the structure of a bag roll.

This invention is so constituted that when bags A are cut off one by one from a roll which is constituted by a series of wrapping bags connected together in a wound roll and made of synthetic resin film having score lines such as perforations or the like, the bags A are cut off one by one by being pulled diagonally upward from the end of the roll in the axial direction.

That is, as an alternative to the conventional method in which the bags A are cut off by being pulled in the tangential direction relative to the outer surface of the roll as the roll is rotated, in the present invention, the bags are drawn out in the form of a string from the outer surface of the roll in the direction parallel to the axis of the roll.

EXAMPLE

Reference numeral 1 represents a container which is secured by screws or the like to an upper plate 4 of a base 3 formed by a cylinder or a polygonal body having a seating plate 2. Reference numeral 5 represents a core post, which is erected vertically at the central portion of the container 1. Reference numeral 6 represents a top cover for the container 1, the top cover being provided with a through hole 7 at the central portion thereof. A cylindrical frictional cutter 8 is secured by screws or the like to the upper surface of the top cover 6 in such a manner that the cylindrical frictional cutter 8 is connected to the through hole 7.

That is, the cylindrical frictional cutter 8 comprises a cylindrical holder 81 made of stainless steel having a flange 82 and a stopper 83 and a cylindrical frictional cutting member 84 made of silicone rubber or the like and having high frictional resistance on the inside surface thereof.

The above-described cylindrical frictional cutting member 84 may be made of silicone or other synthetic resin, natural rubber or synthetic rubber provided that the material has excellent elasticity and has an inside surface with sufficient frictional force to cut the bag roll. The material should preferably have a Shore hardness of 30 to 40 at the surface thereof. A suitable material may be selected in conformity with the material of the rolls to be utilized.

The outer surface of the container 1 may be used as a display medium for an advertisement B or the like. The base 3 may be provided with an opening to form an accommodating chamber 31 for the purpose of, for example, accommodating packing cord 32 or the like. Furthermore, the side surface of the base 3 may be fitted with accessories such as an adhesive tape 33, a cutter 34 or the like.

Next, the way in which the bags A are cut off the bag roll 9 by the bag roll cutting device according to the present invention will now be described.

First, the bag roll 9 is fitted to the core post 5 in the container 1, the end portion of the bag roll 9 is drawn out through the through hole 7 in the top cover 6 and the cylindrical frictional cutting member 84, and the top cover 6 is closed.

In this state, the end portion of the bag roll 9 naturally does not drop into the container 1 after it has been drawn out, as shown in FIG. 1. The reason for this is that the parts of the end portion of the portion of the bag roll 9 drawn through the cylindrical frictional cutting member 84 are brought into contact with the inside surface of the latter with a force acting in the widthwise direction, the inside surface of the cylindrical frictional cutting member 84 providing a strong frictional action.

In this state, the end portion of the bag roll 9 that has been drawn out from the top end portion of the inside surface of the cylindrical frictional cutting member 84 of the cutting device 8 is pulled diagonally upwardly at a suitable angle, and the bag roll 9 is cut at the score 93 of the bag roll 9 when the length of one bag A has been drawn out.

Although in the above-described embodiment, an example is described in which a bag roll is accommodated, an alternative structure may be employed in which a plurality of bag rolls are accommodated and corresponding through holes and frictional cutting devices may be provided in the top cover.

Effect of the Invention

As described above, since the bag roll is unwound from the outer surface of the roll and the front end portion of the bag roll is arranged to be drawn out in the axial direction of the bag roll, the drawing-out resistance can be made constant. Furthermore, since the drawn bag roll is loosely held by the contact resistance between the upper and lower ends of the cylindrical frictional cutting member, the bag roll can be drawn out and cut in a significantly stable manner.

Furthermore, since the bag roll is drawn out from the container through the cylindrical frictional cutting member of the frictional cutting device in a string form, the problem of static electricity can be solved, the end portion of the bag roll can be easily caught, and the bags can be easily opened once they have been cut off the roll.

Furthermore, since the bag roll can be stood in a vertical state for use, the device can be designed in a compact manner and can be freely and easily located. Furthermore, since the bag roll is accommodated in a container, the bags are kept in a sanitary state which makes the invention highly suitable as a cutting device for bag rolls to be used in wrapping pieces of food.

What is claimed is:

1. A bag roll cutting device comprising:

a cylindrical or prism-shaped container which accommodates in a vertical state a bag roll constituted by a series of wrapping bags forming a continuous roll, said series of wrapping bags being constituted by an elongated cylindrical synthetic resin film flattened in the form of a band on which straight-line welding is applied at a certain interval to form bottoms with scored lines in a form provided adjacent to said bottoms such as perforations;

a top cover which is detachably fitted to said container, and which has a through hole of a certain size; and a cylindrical frictional cutter which is secured and connected to said through hole in said top cover, said cutter comprising a tubular member having a high degree of frictional resistance on the inside surface thereof, wherein the front end portion of said bag roll is gathered in the form of a string in the axial direction of said bag roll and drawn out from said container through said tubular member, and said bag roll is cut at said score lines by virtue of the tension caused by pulling said front end diagonally and the friction generated by said tubular member.

2. The device of claim 1 wherein said member has a smooth interior surface.

3. The device as defined in claim 2 wherein the Shore hardness of said interior surface is 30 to 40.

4. The device as defined in claim 3 wherein said tubular member comprises a material selected from the group consisting of synthetic resin, silicone, natural rubber, and synthetic rubber.

5. The device of claim 1 wherein said cutter comprises a tubular member having a internal diameter smaller than the axial length of said member.

6. In a device for removing a bag from a wound roll of said bags separated by perforations, the improvement comprising:

a tubular member having a smooth interior surface through which said bag is drawn, the inside surface of said member having an axial length at least equal to said inside surface's interior diameter and providing frictional resistance to movement of said bag for a distance at least equal to the internal diameter of said member, whereby said bag is separated at said perforations.

7. A device for separating a single bag from a subtantially cylindrical roll of bags joined with separable seams, comprising:

a container for vertically accommodating said roll of bags;

a top cover detachably carried by said container, said top cover having a hole; and a tubular member carried by said top cover, having a substantially smooth interior surface generally aligned with said hole, and having an axial length at least as great as the diameter of said interior surface, and wherein said tubular member comprises a material having a Shore hardness of 30 to 40 selected from the group consisting of synthetic resin, silicone, natural rubber, and synthetic rubber;

whereby the single bag may be separated from said roll of bags at the one of said separable seams between said bag and said roll of bags by frictional resistance when the single bag is drawn through the tubular member.

* * * * *